US008647132B2

(12) United States Patent
Kuroda et al.

(10) Patent No.: US 8,647,132 B2
(45) Date of Patent: Feb. 11, 2014

(54) CONNECTOR WITH FLUID DISCHARGE HOLE IN HOUSING AND FLUID DRAINAGE PATH IN SEAL

(75) Inventors: Shinya Kuroda, Yokkaichi (JP); Koji Ohara, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 57 days.

(21) Appl. No.: 13/358,607

(22) Filed: Jan. 26, 2012

(65) Prior Publication Data

US 2012/0202368 A1 Aug. 9, 2012

(30) Foreign Application Priority Data

Feb. 7, 2011 (JP) ..... 2011-024093

(51) Int. Cl.
*H01R 13/52* (2006.01)

(52) U.S. Cl.
USPC ..... 439/271; 439/587

(58) Field of Classification Search
USPC ..... 439/271–275, 587–589
See application file for complete search history.

(56) References Cited

U.S. PATENT DOCUMENTS

| | | | | |
|---|---|---|---|---|
| 5,145,410 | A * | 9/1992 | Maejima et al. | 439/587 |
| 5,538,441 | A * | 7/1996 | Paolucci et al. | 439/589 |
| 5,634,807 | A | 6/1997 | Saito | |
| 5,766,039 | A * | 6/1998 | Abe | 439/587 |
| 5,931,699 | A | 8/1999 | Saito | |
| 6,290,521 | B1 | 9/2001 | Suzuki et al. | |
| 7,114,991 | B2 * | 10/2006 | Shiga et al. | 439/587 |
| 7,337,244 | B2 * | 2/2008 | Furukawa et al. | 710/33 |
| 7,371,115 | B1 * | 5/2008 | Hsieh et al. | 439/587 |
| 7,637,764 | B2 * | 12/2009 | Yoneda et al. | 439/275 |

FOREIGN PATENT DOCUMENTS

JP 2004328842 11/2004

* cited by examiner

*Primary Examiner* — Thanh Tam Le
(74) *Attorney, Agent, or Firm* — Gerald E. Hespos; Michael J. Porco; Matthew T. Hespos

(57) ABSTRACT

A connector (X) includes a housing (10) with a plurality of terminal accommodating chambers (14). An accommodating recess (11) is formed in a rear surface of the housing (10) and communicates with the rear ends of the terminal accommodating chambers (14). A rubber plug (20) is accommodated in the accommodating recess (11) and includes a plurality of wire insertion holes (22) corresponding to the terminal accommodating chambers (14). Drainage paths (23) are formed in the rear surface of the rubber plug (20) and reach the outer periphery thereof.

12 Claims, 15 Drawing Sheets

CONNECTOR WITH FLUID DISCHARGE HOLE IN HOUSING AND FLUID DRAINAGE PATH IN SEAL

BACKGROUND OF THE INVENTION

1. Field of the Invention

The present invention relates to a connector.

2. Description of the Related Art

U.S. Pat. No. 6,290,521 discloses a waterproof type connector with a housing that has a plurality of terminal accommodating chambers. An accommodating recess is formed in the rear end of the housing and communicates with the rear ends of the terminal accommodating chambers. A one-piece rubber plug is accommodated in the accommodating recess and has wire insertion holes corresponding to the terminal accommodating chambers. Wires from the terminal accommodating chambers are passed through the wire insertion holes and are drawn out backward from the rubber plug.

Water may stay on the one-piece rubber plug if this connector is used in a posture with the rear end surface of the rubber piece faced up. Water that stays on the rear surface of the one-piece rubber plug may enter the terminal accommodating chambers through clearances between the wire insertion holes and the wires.

The invention was made in view of the above situation and an object thereof is to prevent water from staying on the rear end surface of a one-piece rubber plug.

SUMMARY OF THE INVENTION

The invention relates to a connector with a housing that has a plurality of terminal accommodating chambers. At least one accommodating recess is formed in the rear end surface of the housing and communicates with the rear ends of the terminal accommodating chambers. A resilient member is accommodated in the accommodating recess and has wire insertion holes substantially corresponding to the terminal accommodating chambers. At least one drainage path reaches from the rear surface to the outer peripheral edge of the resilient member.

Water or any other liquid on the rear surface of the resilient member can be discharged from the outer peripheral edge of the one-piece rubber plug through the drainage path and will not stay on the rear surface of the rubber plug.

The drainage path preferably communicates edges of the wire insertion holes. Thus, water at rear ends of the wire insertion holes can be discharged reliably.

The resilient member preferably is formed with at least one communication path that allows communication between the edge portions of two wire insertion holes. Thus, a drainage path extending to the outer peripheral edge of the plug from the wire insertion hole closer to the outer peripheral edge also functions as part of the drainage path for the wire insertion hole more distant from the outer peripheral edge.

A peripheral wall of the accommodating recess preferably has at least one discharging portion that allows the drainage path and the communication path to communicate with the outer surface of the peripheral wall. Thus, liquid or fluid that reaches the outer peripheral edge of the resilient member via the drainage path can be discharged to the outside of the accommodating recess via the discharging portion.

The resilient member preferably is symmetrical with respect to forward and backward directions and at least one projection preferably is formed on the back end surface of the accommodating recess. The projection is disposed to engage with the drainage path. Thus, it is not necessary to consider the forward and backward orientation of the resilient member when mounting the resilient member into the accommodating recess. Further, mutual engagement of the drainage path and the projection when the resilient member is mounted prevents improper deformation and displacement of the front of the resilient member. Therefore, the front openings of the wire insertion holes align properly with the rear openings of the terminal accommodating chambers.

The drainage path preferably is a groove that is open in a rear end surface of the resilient member and preferably has a rectangular or polygonal cross section. The drainage path also preferably extends substantially straight.

The connector also may comprise a resilient member holder to be mounted on the housing for holding the resilient member in a slightly compressed state. The resilient member holder preferably includes a main portion with at least one through hole that penetrates the main portion in thickness direction and substantially corresponds to the wire insertion hole. The resilient member holder preferably closes at least part of the rear opening of the accommodating recess.

The resilient member preferably is made of rubber or gelatinous material.

The resilient member preferably comprises at least one outer peripheral lip portion on its outer peripheral surface and provided to adhere to an inner peripheral surface of the peripheral wall portion in a fluid- or liquid-tight manner when the resilient member is accommodated in the accommodating recess.

At least one inner peripheral lip is formed on the inner periphery of the wire insertion hole having a minimum inner diameter that is smaller than the outer diameter of a wire to be inserted into the wire insertion hole.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
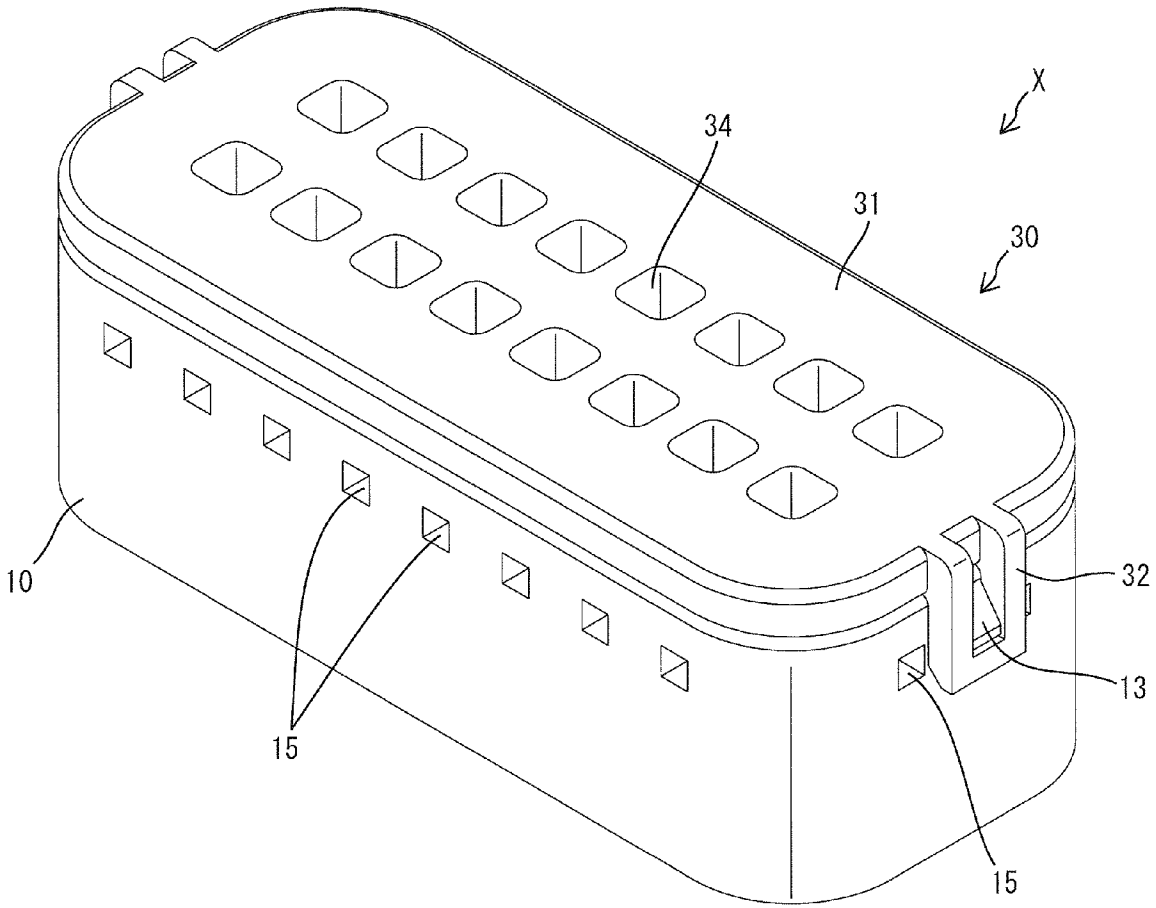
FIG. 1 is a perspective view of a connector according to a first embodiment.
Figure 2:
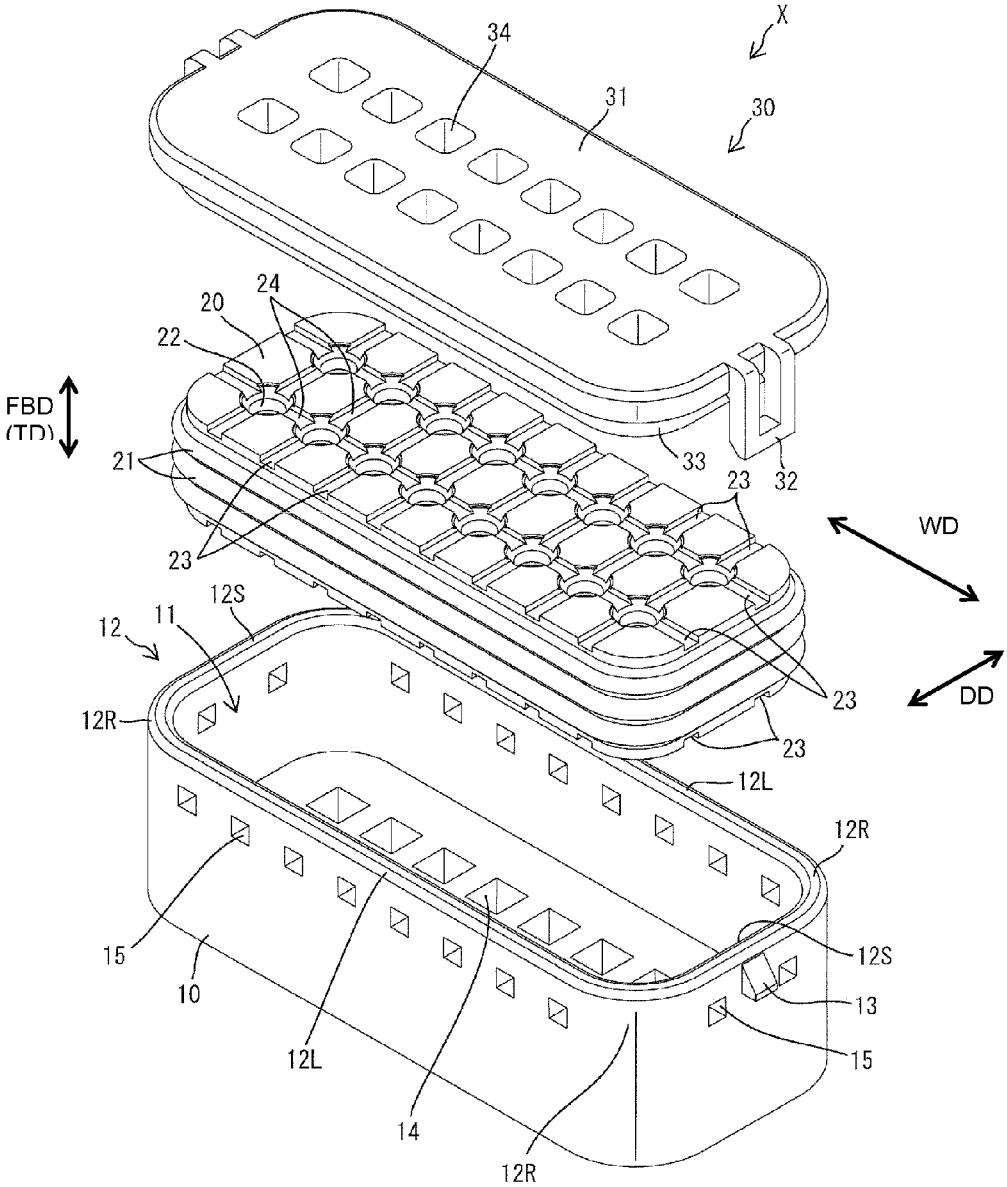
FIG. 2 is a perspective view showing a state where a housing, a one-piece rubber plug and a rubber plug holder are separated.
Figure 3:
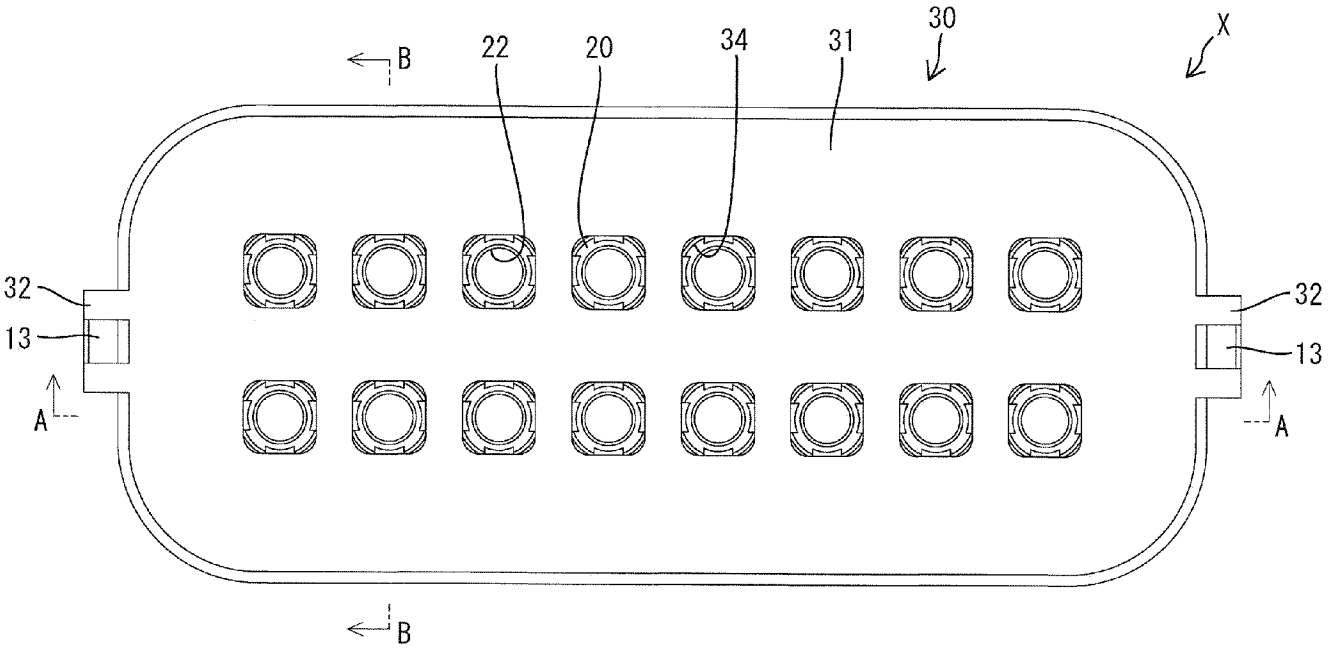
FIG. 3 is a rear view of the connector.
Figure 4:
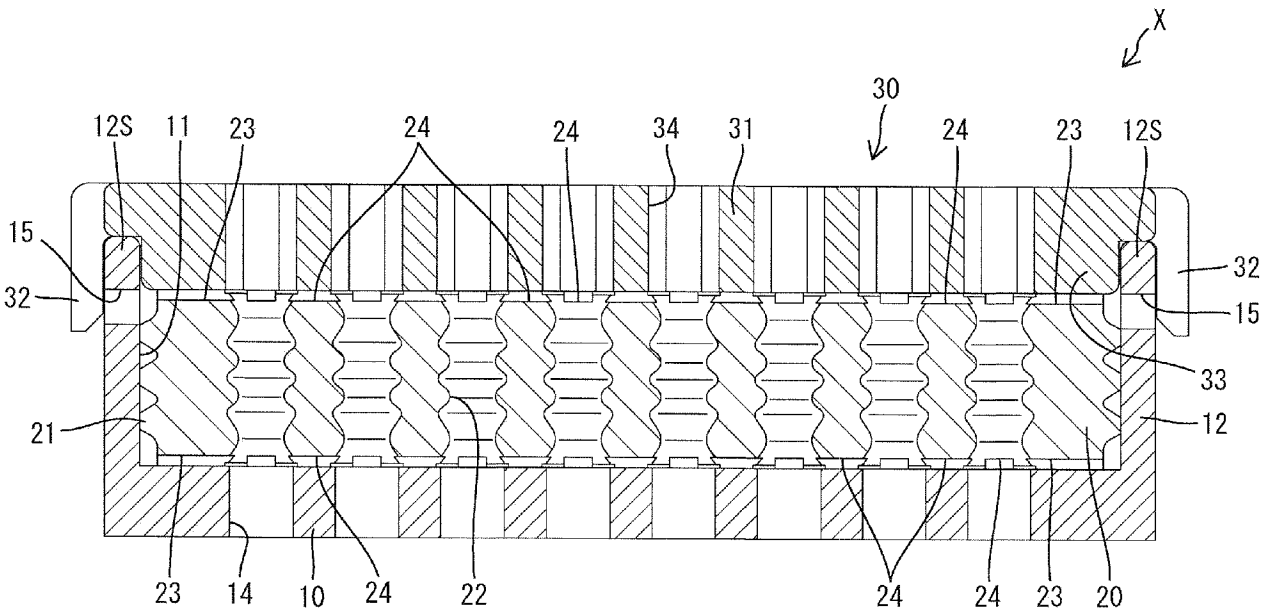
FIG. 4 is a section along A-A of FIG. 3.
Figure 5:
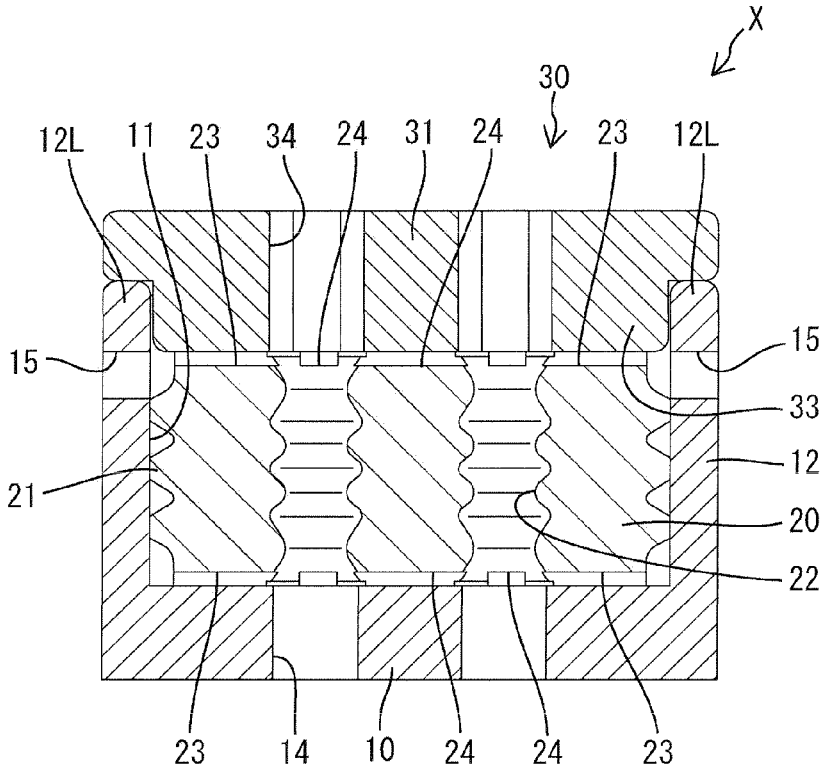
FIG. 5 is a section along B-B of FIG. 3.

A first embodiment of the invention is described with reference to FIGS. 1 to 5. A connector X of this embodiment includes a housing 10 substantially in the form of a block made e.g. of synthetic resin. A resilient member in the form of a one-piece rubber plug 20 is to be mounted in a rear end of the housing 10 and a rubber plug holder 30 is mounted on the rear end of the housing 10. In the following description, directions are defined based on a state in which the rear end surfaces of the housing 10, the one-piece rubber plug 20 and the rubber plug holder 30 are faced up. Further, only a rear part of the housing 10 is shown and a front half part is not shown.

A rearwardly open accommodating recess 11 is formed in the rear end of the housing 10. The opening of the accommodating recess 11 has a substantially rectangular shape whose dimension in a width direction is larger than a dimension in a depth direction. A peripheral wall 12 of the accommodating recess 11 comprises two long panels 12L along the width direction, two short panels 12S along the depth direction, and four quarter-circular arcs 12R smoothly connecting ends of the long and short panels 12L, 12S. The inner peripheral surface of the peripheral 12 defines a sealing surface. Further, locking projections 13 are formed on the outer surfaces of the short panels 12S.

Sixteen terminal accommodating chambers 14 penetrate through the housing 10 in forward and backward directions and the rear ends of the terminal accommodating chambers 14 open in the back end surface of the accommodating recess 11. In the shown example, the terminal accommodating chambers 14 are in two linear rows in the depth direction DD, and eight terminal accommodating chambers 14 are arranged at substantially constant intervals or pitches in the width direction WD in each row. A terminal fitting (not shown) of a known form is to be inserted into each terminal accommodating chambers 14.

The resilient member is a one-piece rubber plug 20 that is shaped substantially symmetrically with respect to forward and backward directions FBD (thickness direction TD), width direction WD and depth direction TD. The opposite front and rear end surfaces of the one-piece rubber plug 20 are substantially rectangular, and a dimension in the thickness direction TD (forward and backward directions FBD) is smaller than the depth of the accommodating recess 11 in forward and backward directions FBD. The rubber plug 20 is mounted into the housing 10 by being fit into the accommodating recess 11 from behind. In a mounted state, the front end surface of the rubber plug 20 contacts the back end surface of the accommodating recess 11 and outer peripheral lips 21 on the outer peripheral surface of the rubber plug 20 contact the inner peripheral surface of the peripheral wall portion 12 in a fluid- or liquid-tight manner while being resiliently deformed. Sixteen substantially round wire insertion holes 22 penetrate the rubber plug 20 in forward and backward directions FBD and are arrayed in the width direction WD and the depth direction DD to correspond to the respective terminal accommodating chambers 14 when the rubber plug 20 is mounted to the housing 10. Inner peripheral lips are formed on the inner peripheries of the wire insertion holes 22 and have minimum inner diameters smaller than the outer diameter of wires (not shown).

The rubber plug holder 30 is made e.g. of synthetic resin and includes a main portion 31 in the form of a substantially rectangular plate that entirely closes the rear end opening of the accommodating recess 11 and two resilient locking pieces 32 project forward from opposite sides of the main portion 31 in the width direction WD. An outer peripheral edge of the front end surface of the main portion 31 is cut off over substantially the entire periphery, and a remaining area of the main portion 31 defines a fitting 33 to be fit into a rear end portion of accommodating recess 11. Sixteen substantially rectangular through holes 34 penetrate the main portion 31 in forward and backward directions FBD and are arrayed in the width direction WD and the depth direction DD to correspond to the wire insertion holes 22 and the terminal accommodating chambers 14 when the rubber plug holder 30 is mounted into the housing 10.

The rubber plug holder 30 is mounted into the housing 10 from behind and is held in a mounted state by the engagement of the resilient locking pieces 32 and the locking projections 13. In the mounted state of the rubber plug holder 30, the front surface of the fitting portion 33 is pressed against the rear surface of the one-piece rubber plug 20 mounted in the accommodating recess 11 so the one-piece rubber plug 20 is held in the accommodating recess 11 while being slightly compressed and prevented from coming out backward and being displaced.

Each terminal fitting is inserted into the terminal accommodating chamber 14 from behind while successively passing through the through hole 34 and the wire insertion hole 22. A wire connected to a rear end of the properly inserted terminal fitting is inserted through the wire insertion hole 22 in a liquid-tight manner and drawn out backward through the through hole 34 of the rubber plug holder 30. The wire is thinner than the terminal fitting and the through hole 34 is dimensioned to allow passage of the terminal fitting. Thus, a relatively large clearance is formed between the inner periphery of the through hole 34 and the outer periphery of the wire. Thus, water or other liquid may reach the rear end surface of the one-piece rubber plug 20 from the back side of the connector X through this clearance. A means for discharging the water on the rear surface of the one-piece rubber plug 20 is described below as a countermeasure.

Drainage paths 23 are formed in the rear end surface of the one-piece rubber plug 20 and extend from the edges of the respective wire insertion holes 22 to the outer peripheral edge of the rubber plug 20. The drainage paths 23 are substantially straight grooves with substantially rectangular cross sections that open in the rear surface of the rubber plug 20. One drainage path 23 extends in the width direction WD and one drainage path 23 extends in the depth direction DD from each of the four wire insertion hole 22 at the opposite sides in the width direction. Further, one drainage path 23 extends in the depth direction DD from each of the twelve wire insertion holes 22 other than those at the opposite sides in the width direction WD. Thus, at least one drainage path 23 substantially communicate with each wire insertion hole 22.

Fourteen communication paths 24 are formed in the rear end surface of the one-piece rubber plug 20 and allow communication of the edges of the respective wire insertion holes 22 adjacent in the width direction WD. Similar to the drainage paths 23, the communication paths 24 are straight grooves of rectangular cross section that are open in the rear end of the rubber plug 20. Eight communication paths 24 are formed in the rear end surface of the rubber plug 20 and allow communication of the edges of the wire insertion holes 22 that are adjacent in the depth direction DD. Thus, the wire insertion holes 22 communicate with the communication paths 24 and the drainage paths 23 communicate with any one of the communication paths 24 via the wire insertion hole 22. Similar to the drainage paths 23, the communication paths 24 are in the form of straight grooves or recesses which are open in the rear end surface of the rubber plug 20 and have a substantially rectangular cross section.

The drainage paths 23 and communication paths 24 are aligned straight via the wire insertion holes 22 in the width direction WD and are aligned straight via the wire insertion holes 22 in the depth direction DD. Thus, the rear surface of the rubber plug 20 has two flow paths composed of the drainage paths 23 and the communication paths 24 that extend in the width direction WD to open in the outer peripheral edge of the rubber plug 20 and eight flow paths composed of the drainage paths 23 and the communication paths 24 that extend in the depth direction DD to open in the outer peripheral edge of the rubber plug 20. Additionally, the two flow paths extending in the width direction WD and the eight flow paths extending in the depth direction WD cross at substantially right angles at the wire insertion holes 22. The rubber plug 20 is substantially symmetrical with respect to forward and backward directions FBD. Thus, the same numbers of drainage paths 23 and communication paths 24 also are formed in the same arrangement in the front end surface of the rubber plug 20.

Discharging portions 15 penetrate through the peripheral wall 12 and allow communication between the interior and exterior of the accommodating recess 11. The discharging portions 15 are substantially rectangular openings, and opening areas thereof are closed over the entire circumferences like windows (i.e. not open at the rear end edge of the peripheral wall 12). Thus, the discharging portions 15 are formed at a distance from an opening edge of the peripheral wall 12 and have a window-like shape closed at its sides. The discharging portions 15 are provided at positions corresponding to the opening ends of the respective drainage paths 23 at the outer peripheral edge of the rubber plug 20 and on extensions in length directions of the drainage paths 23 and/or the communication paths 24. That is, one discharging portion 15 is arranged for each drainage path 23. Further, in forward and backward directions FBD the opening areas of the discharging portions 15 enclose the opening areas of the drainage paths 23 in the outer peripheral surface of the one-piece rubber plug 20. That is, in forward and backward directions FBD, the rear edges of the opening edges of the discharging portions 15 are located at the same positions as the rear surface of the rubber plug 20 and the front edges of the opening edges of the discharging portions 15 are located before the opening areas of the drainage paths 23 in the outer peripheral surface of the one-piece rubber plug 20.

According to the above construction, water (or any other fluid) having reached the rear end surface of the one-piece rubber plug 20 through the through holes 34 reaches the outer periphery of the rubber plug 20 via various paths such as: paths in which the water passes only through the drainage path 23, paths in which the water successively passes through the wire insertion hole 22 and the drainage path 23, paths in which the water successively passes through the communication path 24, the wire insertion hole 22 and the drainage path 23, paths in which the water successively passes through the wire insertion hole 22, the communication path 24, another wire insertion hole 22 and the drainage path 23, and/or paths in which the water passes through the drainage path 23 after alternately passing through a plurality of communication paths 24 and a plurality of wire insertion holes 22, and then is discharged to the outside of the accommodating recess 11 (housing 10) through the discharging portions 15.

The connector X has the housing 10 formed with terminal accommodating chambers 14. The accommodating recess 11 is recessed in the rear end of the housing 10 and communicates with the rear ends of the terminal accommodating chambers 14. The one-piece rubber plug 20 has wire insertion holes 22 corresponding to the terminal accommodating chambers 14 and is accommodated in the accommodating recess 11, and the drainage paths 23 are formed in the rear end surface of the rubber plug 20 and reach the outer periphery. Thus, water (or any other fluid) on the rear surface of the rubber plug 20 can be discharged from the outer periphery of the rubber plug 20 via the drainage paths 23. Therefore, water does not stay on the rear surface of the rubber plug 20.

The drainage paths 23 communicate with the edges of the wire insertion holes 22. Thus, water at the rear ends of the wire insertion holes 22 can be discharged reliably. Further, the peripheral wall 12 of the accommodating recess 11 is formed with the discharging portions 15 that communicate with the drainage paths 23 with the peripheral wall portion 12. Hence, fluid that reaches the outer periphery of the rubber plug 20 via the drainage paths 23 is discharged reliably to the outside of the accommodating recess 11 via the discharging portions 15. Further, the rubber plug 20 is substantially symmetrical with respect to forward and backward directions FBD (thickness direction TD). Therefore, it is not necessary to consider the forward and backward orientation when mounting the rubber plug 20 into the accommodating recess 11 so that operability is good.

Two wire insertion holes 22 may be aligned in the width direction WD. Two separate drainage paths could extend from these two wire insertion holes 22 toward the outer peripheral edge of the one-piece rubber plug 20. However, in this embodiment, the communication paths 24 allow communication of the edges of the two adjacent wire insertion holes 22 and communicate with the drainage paths 23 via the wire insertion holes 22. Thus, the drainage path 23 from the wire insertion hole 22 closer to the outer peripheral edge of the rubber plug 20 can double as the drainage path 23 for the wire insertion hole 22 more distant from the outer peripheral edge. Therefore, the length of the drainage path can be shortened and the drainage function can be improved.

Figure 6:
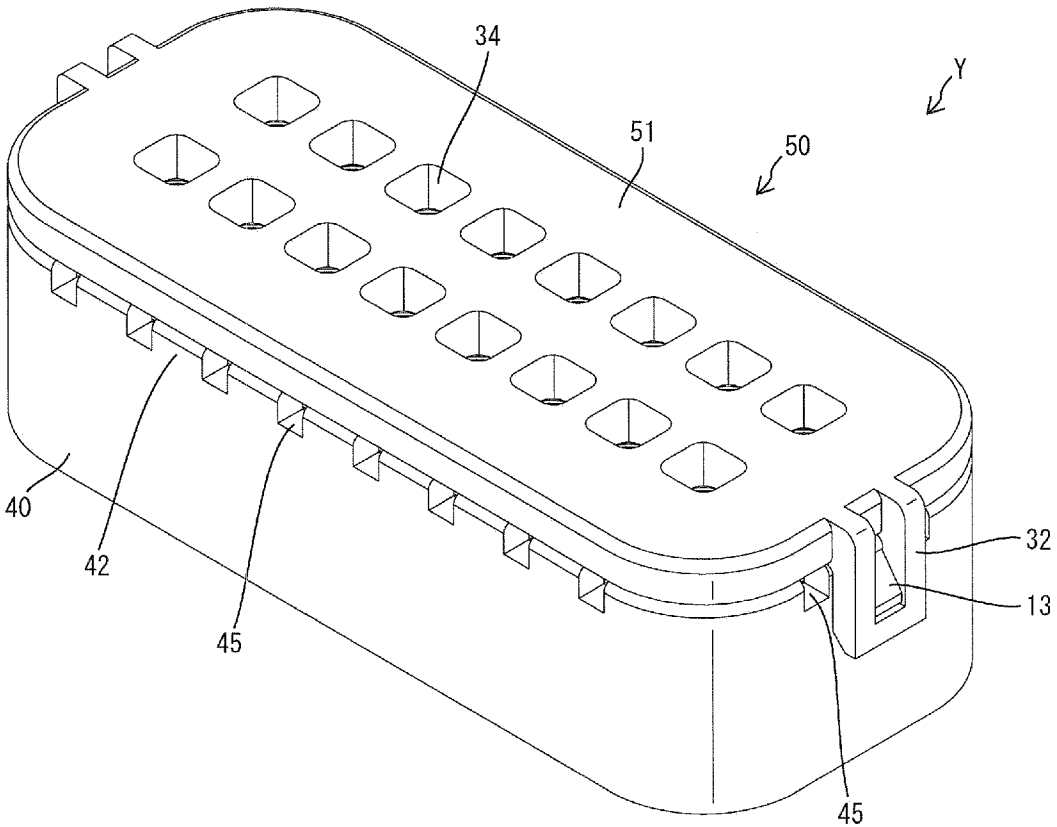
FIG. 6 is a perspective view of a connector of a second embodiment.
Figure 7:
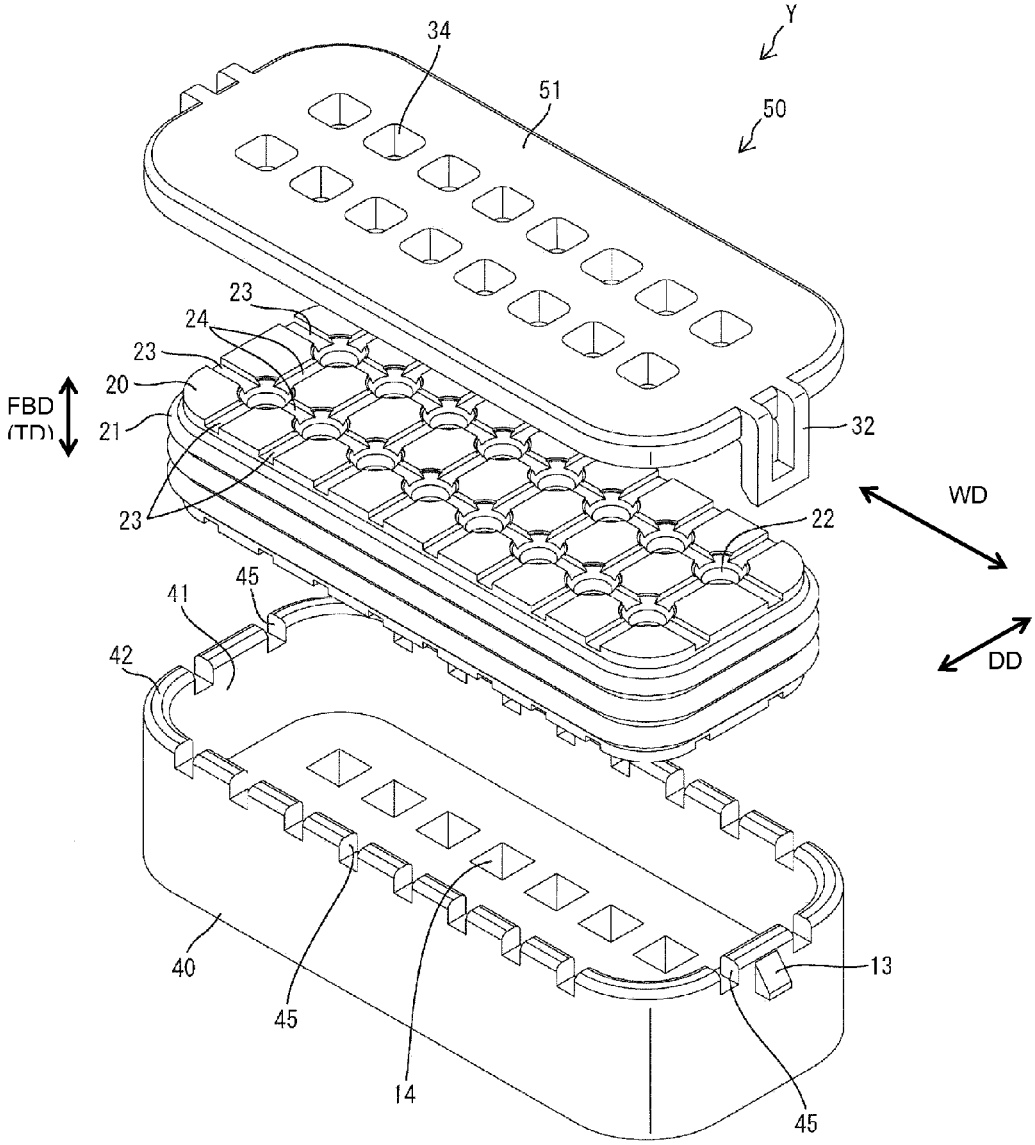
FIG. 7 is a perspective view showing a state where a housing, a one-piece rubber plug and a rubber plug holder are separated.
Figure 8:
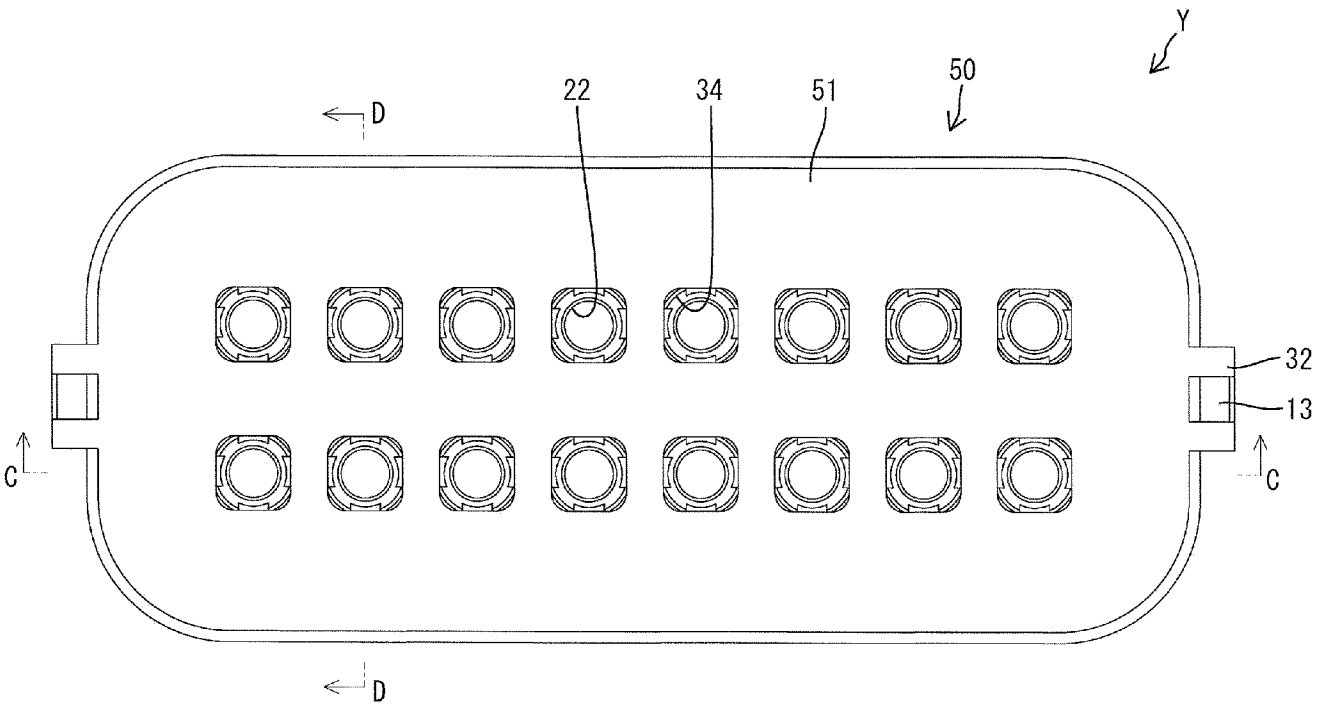
FIG. 8 is a rear view of the connector.
Figure 9:
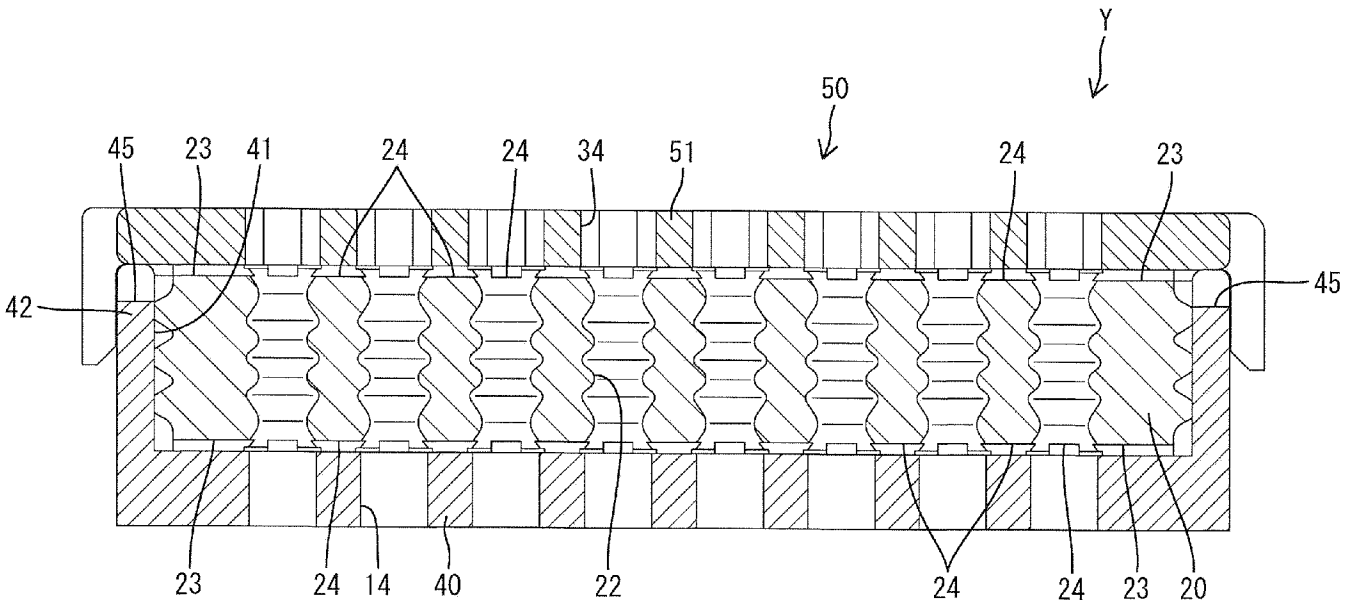
FIG. 9 is a section along C-C of FIG. 8.
Figure 10:
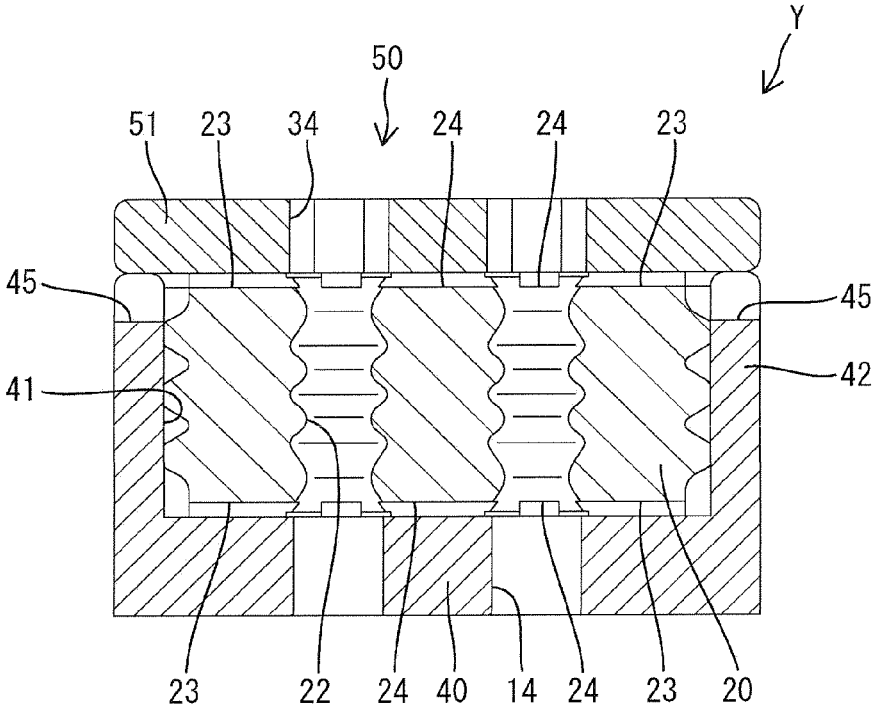
FIG. 10 is a section along D-D of FIG. 8.

A second of the invention is described with reference to FIGS. 6 to 10. A connector Y of this embodiment differs from the first embodiment in the forms of an accommodating recess 41 of a housing 40 and a plug holder 50. The other constructions are similar to the first embodiment and are identified by the same reference numerals but are not described again.

The opening areas of the discharging portions 15 of the first embodiment are closed over the entire circumferences like window holes (i.e. not open at the rear end edge of the peripheral wall 12). Discharging portions 45 of the second embodiment are formed so that the rear ends of the opening areas thereof are open at the rear end edge of a peripheral wall 42. The discharging portions 45 are substantially rectangular cutouts made at the rear end edge of the peripheral wall 42. The depth of the accommodating recess 41 in forward and backward directions FBD is smaller than in the accommodating recess 11 of the first embodiment, and the rear end surface of a one-piece rubber plug 20 mounted in the accommodating recess 41 and the rear end surface of the peripheral wall 42 are at the same position in forward and backward directions. A main portion 51 of the plug holder 50 is not formed with a part corresponding to the fitting portion 33 of the first embodiment, and the front surface of the main portion 51 is a flat surface free from any step over the entire area. The rear end surface of the one-piece rubber plug 20 can be pressed by the front surface of the main portion 51.

Figure 11:
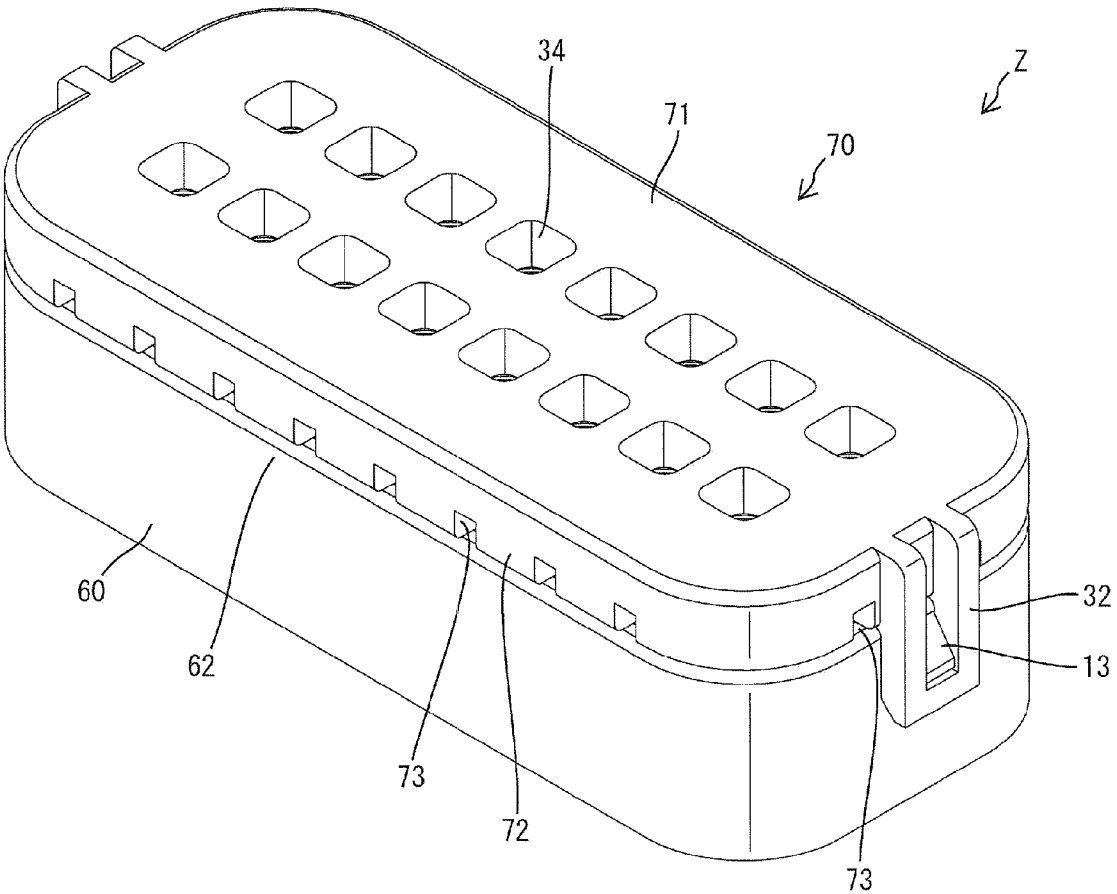
FIG. 11 is a perspective view of a connector of a third embodiment.
Figure 12:
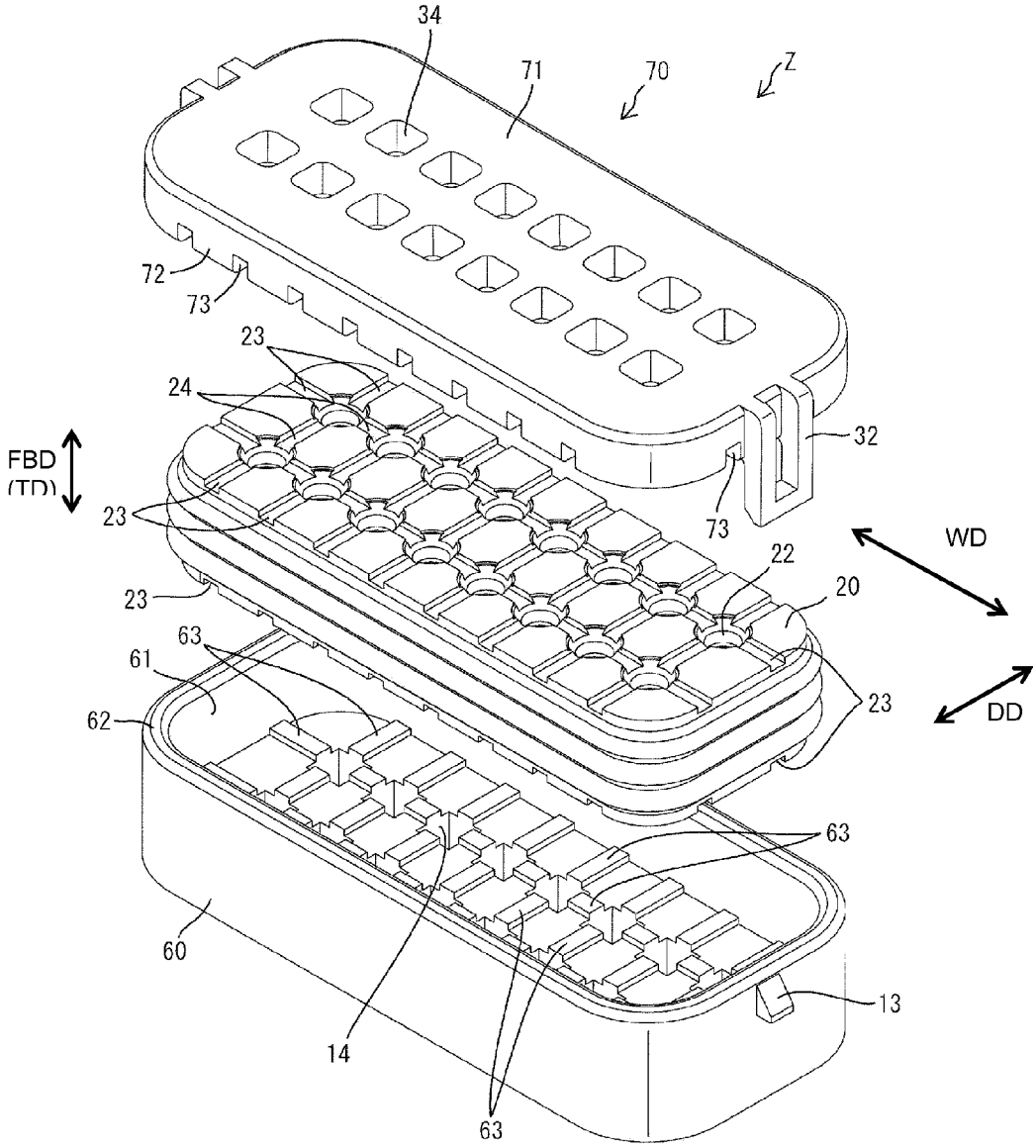
FIG. 12 is a perspective view showing a state where a housing, a one-piece rubber plug and a rubber plug holder are separated.
Figure 13:
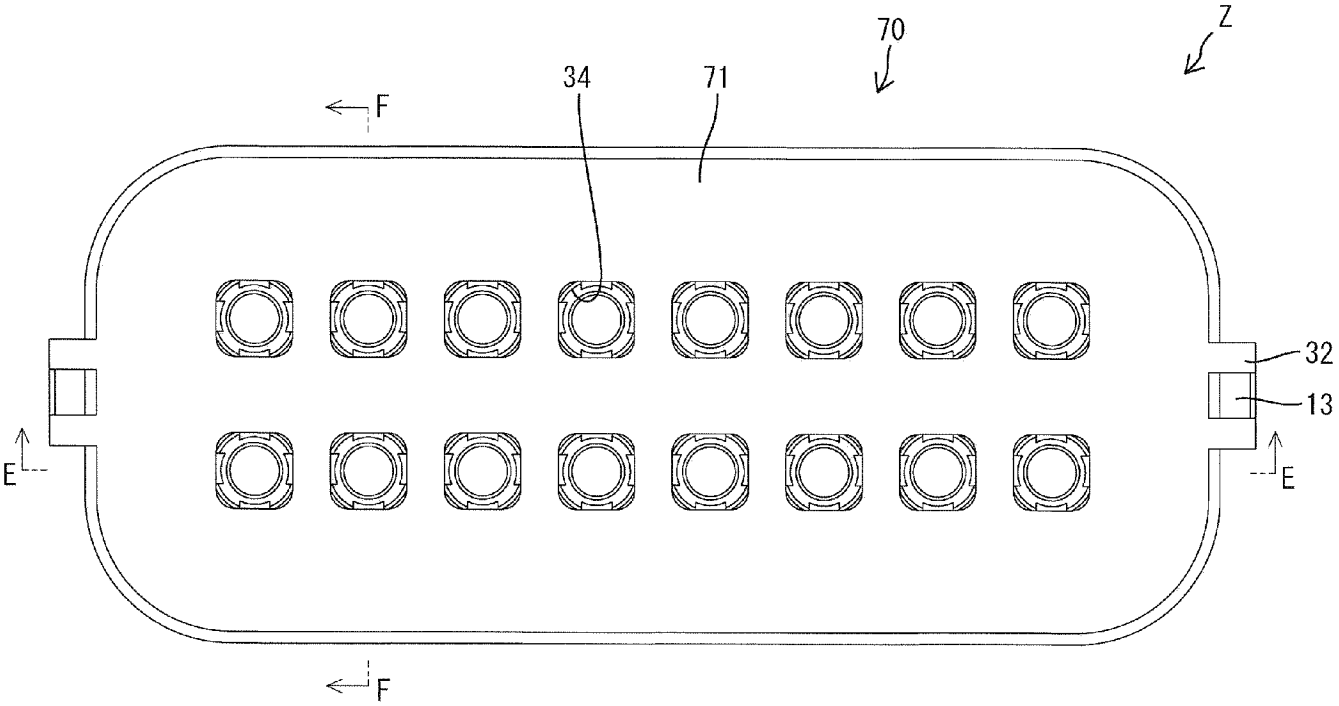
FIG. 13 is a rear view of the connector.
Figure 14:
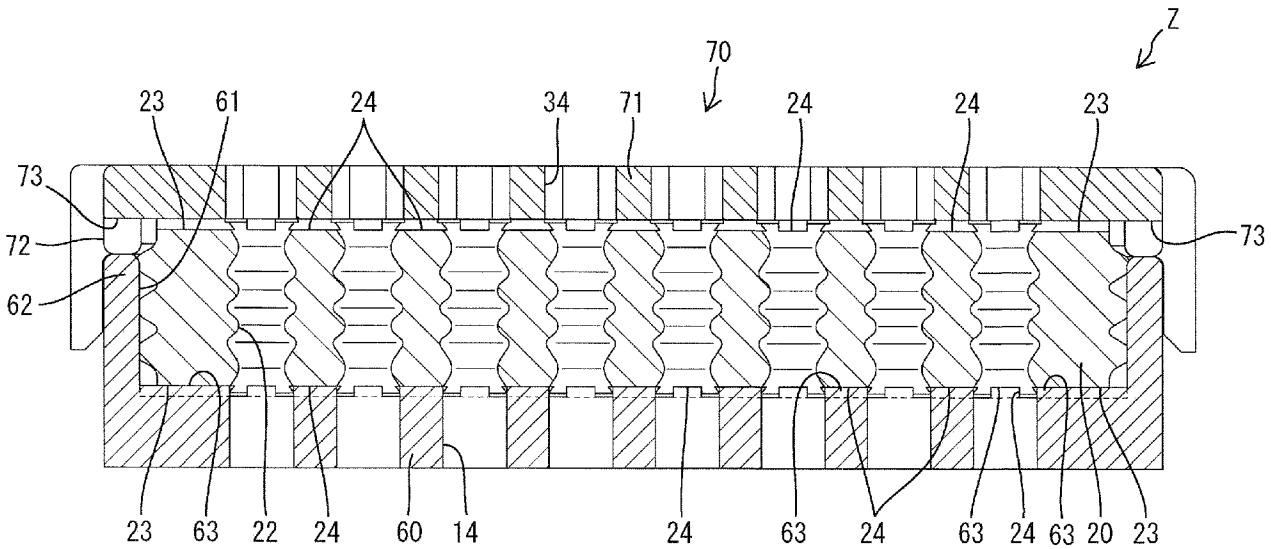
FIG. 14 is a section along E-E of FIG. 13.
Figure 15:
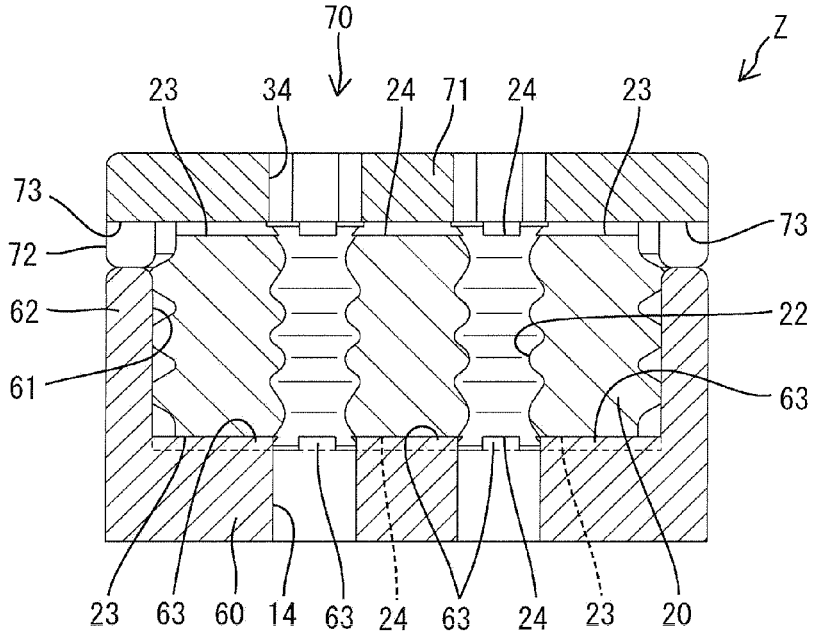
FIG. 15 is a section along FF of FIG. 13.

A third embodiment of the invention is described with reference to FIGS. 11 to 15. A connector Z of this embodiment differs from the first embodiment in a housing 60 and a plug holder 70. Other constructions that are similar to the first embodiment are identified by the same reference numerals, but are not described.

The discharging portions 15 are formed in the peripheral wall 12 of the accommodating recess 11 in the first embodiment. However, discharging portions 73 are formed not in a peripheral wall 62 of an accommodating recess 61, but in a plug holder 70, in the third embodiment. That is, the depth of the accommodating recess 61 is smaller in forward and backward directions FBD than the accommodating recess 11 of the first embodiment, and the rear end surface of a rubber plug 20 mounted in the accommodating recess 61 projects back from the rear end surface of the peripheral wall 62. An outer fitting 72 is formed over substantially the entire periphery on the front surface of a main portion 71 of the plug holder 70. The outer fitting 72 projects forward like a rib along the outer peripheral edge of the main portion 71. Rectangular cutouts are formed in a front end edge of the outer fitting 72 to form the discharging portions 73.

With the plug holder 70 mounted in the housing 60, the front end of the outer fitting 72 contacts the rear end of the peripheral wall 62 and the front surface of the main portion 71 presses the rear surface of the rubber plug 20. Further, the outer fitting 72 surrounds a rear portion of the rubber plug 20 projecting back from the rear end of the peripheral wall 62 over substantially the entire periphery. The discharging portions 73 formed in the outer fitting 72 are located to correspond to respective drainage paths 23 on the rear end surface of the rubber plug 20.

The rubber plug 20 of the third embodiment is symmetric with respect to forward and backward directions FBD and the drainage paths 23 and communication paths 24 in the form of grooves are formed in the front end surface. The projections 63 to the drainage paths 23 and the communication paths 24 are formed in the back end surface of the accommodating recess 61. With the plug holder 70 mounted in the housing 60, the drainage paths 23 and the communication path 24 engage with the projections 63, thereby preventing displacements of the front end of the rubber plug 20 relative to the accommodating recess 61 in the width direction WD and the depth direction DD and preventing improper resilient deformations thereof. In this way, the front openings of wire insertion holes 22 maintain a proper positional relationship with the rear openings of terminal accommodating chambers 14.

The invention is not limited to the above described and illustrated embodiments, and the following embodiments also are in the scope of the invention.

The drainage paths are grooves that are entirely in the rear end surface of the rubber plug in the first to third embodiments, but they may be such that the opposite ends are open in the rear end surface and at the outer peripheral edge of the rubber plug and the other areas are located in the rubber plug.

The drainage paths communicate with the edges of the wire insertion holes in the first to third embodiments. However, only some of the drainage paths may communicate with the edges of the wire insertion holes.

Although the drainage paths are straight in the first to third embodiments, they may be curved or bent.

The hole edges of all the pairs of wire insertion holes in an adjacent positional relationship in the width direction or the depth direction communicate with each other via the communication paths in the first to third embodiments. However, some pairs of adjacent wire insertion holes may not communicate with each other in this manner.

Two wire insertion holes adjacent in the width or depth direction communicate with each other via the communication path in the first to third embodiments. However, diagonally adjacent wire insertion holes may communicate with each other via communication paths.

Although the communication paths are straight in the above first to third embodiments, they may be curved or bent.

The communication paths that allow communication between two adjacent wire insertion holes may not be formed.

The communication paths and the drainage paths are arranged linearly in the first to third embodiments, but they may be arranged diagonally.

The drainage paths and the communication paths communicate via the wire insertion holes in the first to third embodiments, but they may communicate directly. Thus, the drainage paths may branch from or cross the communication paths.

One discharging portion is provided for each drainage path in the first to third embodiments, but one discharging portion may correspond to plural drainage paths.

The wire insertion holes are arranged in a matrix in the width and depth directions in the first to third embodiments, but they may be arranged in an offset manner.

The one-piece rubber plug is symmetrical with respect to forward and backward directions in the first to third embodiments, but it may be asymmetrical with respect to forward and backward directions. Thus, neither the drainage paths nor the communication paths may be formed in the front surface of the rubber plug in the first and second embodiments and the positions of the drainage paths and the communication paths may be different in the front and rear surfaces in the third embodiment.

The configuration of the third embodiment to engage the drainage paths and the projections is also applicable to the first and second embodiments.

The configuration of the third embodiment to engage the communication paths and the projections is also applicable to the first and second embodiments.

The configuration of the third embodiment to form the discharging portions in the rubber plug holder is applicable to the second embodiment. In this case, one discharging portion can be formed by uniting the discharging portion of the rubber plug holder and the discharging portion of the peripheral wall.

Although sixteen terminal accommodating chambers and wire insertion holes are formed in the first to third embodiments, the numbers of the terminal accommodating chambers and the wire insertion holes may be fifteen or less or seventeen or more.

Although the terminal accommodating chambers and the wire insertion holes are arranged in two separate rows in the depth direction in the above embodiments, the number of rows in the depth direction may be one, three or more.

Although eight terminal accommodating chambers and eight wire insertion holes are arranged in the width direction in the above first to third embodiments, the numbers of the terminal accommodating chambers and the wire insertion holes in the width direction may be seven or less or nine or more.

Although the resilient member has been described in the above embodiments to particularly be a one-piece rubber plug, it should be understood that the resilient member may be formed in several pieces and/or be made of a resilient material different from rubber such as a gelatinous or elastic material which may be a gel or elastic or rubbery material containing three dimensional cross-linked molecular formations or behave as if it contained such molecular formations (geloids). One example of a gel that can be used is silicone gel or resin. Another suitable gel comprises a block copolymer having relatively hard blocks (e.g. hydrogenated rubber blocks) examples of such copolymers including styrene-diene block copolymers (linear or radial) for example styrene-butadiene or styrene-isoprene diblock or triblock copolymers, or styrene-ethylene-butylene-styrenes triblock copolymers. The gel may be formed from a single liquid material which becomes a gel when subjected e.g. to radiation or chemicals; the gel may be formed from two components which become a gel when mixed; or the gel may be a composition which is a gel at working temperature, e.g. room temperature. Additionally or alternatively a gel material as disclosed in U.S. Pat. No. 4,875,870 may be used, which is included herein by reference.

What is claimed is:

1. A connector, comprising:

a housing formed with a peripheral wall and a plurality of terminal accommodating chambers arranged inward of the peripheral wall;

at least one accommodating recess recessed in a rear end of the housing and communicating with rear ends of the terminal accommodating chambers;

at least one discharging portion penetrating through the peripheral wall and allowing communication between an interior and an exterior of the accommodating recess; and a resilient member accommodated in the accommodating recess and including a plurality of wire insertion holes corresponding to the terminal accommodating chambers, at least one drainage path formed in a rear surface of the resilient member and extending from the wire insertion holes to an outer periphery of the resilient member, the at least one drainage path communicating with the at least one discharging portion formed in the peripheral wall, wherein the drainage path is a straight rearwardly open groove and wherein fluid collected on the resilient member is discharged through the drainage path to the discharging portion.

2. The connector of claim 1, wherein the drainage path communicates with edges of the wire insertion holes.

3. The connector of claim 1, wherein the resilient member is formed with at least one communication path that allows communication between the edges of two wire insertion holes and communicates with the drainage path via the wire insertion holes and with the outer periphery of the resilient member.

4. The connector of claim 1, wherein the resilient member is symmetrical with respect to forward and backward directions.

5. The connector of claim 4, wherein at least one projection is formed on a rear surface of the accommodating recess and engages with the drainage path.

6. The connector of claim 1, wherein the rearwardly open groove that defines the drainage path has a substantially polygonal cross section.

7. The connector of claim 1, further comprising a resilient member holder mounted on the housing and holding the resilient member in a compressed state.

8. The connector of claim 7, wherein the resilient member holder includes a main portion and at least one through hole penetrating the main portion in a thickness direction and corresponding to the wire insertion hole.

9. The connector of claim 8, wherein the resilient member holder at least partly closes the accommodating recess.

10. The connector of claim 1, wherein the resilient member comprises at least one outer peripheral lip on the outer periphery to engage an inner peripheral surface of the peripheral wall in a fluid or liquid-tight manner when the resilient member is in the accommodating recess.

11. The connector of claim 1, wherein at least one inner peripheral lip is formed on an inner periphery of the wire insertion hole having a minimum inner diameter smaller than the outer diameter of a wire to be inserted into the wire insertion hole.

12. The connector of claim 1, wherein the resilient member is made of rubber or gelatinous material.

* * * * *